US006886659B2

(12) United States Patent
Simpson

(10) Patent No.: US 6,886,659 B2
(45) Date of Patent: May 3, 2005

(54) CONVERTIBLE LADDER

(75) Inventor: Dennis Simpson, Minnetonka, MN (US)

(73) Assignee: Tricam Industries, Inc., Eden Prairie, MN (US)

( * ) Notice: Subject to any disclaimer, the term of this patent is extended or adjusted under 35 U.S.C. 154(b) by 0 days.

(21) Appl. No.: 10/147,115

(22) Filed: May 16, 2002

(65) Prior Publication Data

US 2003/0146046 A1 Aug. 7, 2003

Related U.S. Application Data

(60) Provisional application No. 60/355,026, filed on Feb. 7, 2002.

(51) Int. Cl.[7] ..... E06C 1/00

(52) U.S. Cl. ..... 182/23; 182/180.1

(58) Field of Search ..... 182/22, 23, 27, 182/180.1, 152, 151, 194, 178.5

(56) References Cited

U.S. PATENT DOCUMENTS

| | | | | |
|---|---|---|---|---|
| 3,476,211 A | * | 11/1969 | Cormier | 182/22 |
| 3,692,143 A | | 9/1972 | Kummerlin et al. | 182/24 |
| 3,811,151 A | | 5/1974 | Kuemmerlin | 16/144 |
| 4,027,741 A | * | 6/1977 | Derrick | 182/22 |
| 4,031,981 A | | 6/1977 | Spencer | 182/153 |
| 4,061,203 A | | 12/1977 | Spencer et al. | 182/214 |

(Continued)

OTHER PUBLICATIONS

Brochure, "Step Stools • Ladders 2001," Cosco, Inc., pp. 1–18 (2001).
Brochure re: The Little Giant (not dated).
Brochure, "Ladders," Tricam Industries, pp. 1–4 (not dated).
Fact Sheet, "Prostep Multi–Folding Ladder, Type I," Tricam Industries, No. 001–1 (3/94).
Brochure, "Jaws / Climbing systems for professionals and do–it–yourselfers," Featherlite Industries (1996).
Spec sheet, "Fiberglass VersaLadder™," Versa Products Inc. (not dated).
Brochure, "VersaLadder™, The Original, Amazing, Multi-purpose, Heavy–duty, Folding Ladder?" Versa Products Inc. (not dated).
Brochure, "VersaLadder™" (6/93).
Brochure, "Unless your ladder looks like this . . . and does this . . . " Wing Enterprises, Inc. (not dated).
Operating and Safety Instructions, "Little Giant Ladder Systems, Type IA," Wing Enterprises, Inc. (8/90).
Brochure, "Ladders," Keller Ladders, Inc. (08/98).
Brochure, "Columbia & Blue Ribbon 1999 Ladders," Columbia Ladders/Blue Ribbon Ladders (1999).
Keller™ 2000/2001 Product Catalog, p. 8 (2000).
Brochure, Krause (1997).
Brochure, "The Little Giant Ladder System® FIBER-GLASS," Wing Enterprises (date obscured).

*Primary Examiner*—Alvin Chin-Shue
(74) *Attorney, Agent, or Firm*—Patterson, Thuente, Skaar & Christensen, PA; Michael A. Bondi

(57) ABSTRACT

A convertible ladder including a first ladder portion, a second ladder portion and a static hinge mechanism. The first ladder portion has a first locking mechanism proximate a first end thereof. The second ladder portion has a second locking mechanism proximate a first end thereof. The static hinge mechanism is attached to the first ladder portion with the first locking mechanism. The static hinge mechanism is attached to the second ladder portion with the second locking mechanism. The static hinge mechanism maintains the first ladder portion in a stationary relation with respect to the second ladder portion.

15 Claims, 2 Drawing Sheets

U.S. PATENT DOCUMENTS

| | | | | | |
|---|---|---|---|---|---|
| D248,777 | S | | 8/1978 | Spencer et al. | D25/68 |
| RE30,020 | E | | 6/1979 | Spencer et al. | 182/153 |
| 4,182,431 | A | | 1/1980 | Wing | 182/23 |
| 4,210,224 | A | | 7/1980 | Kummerlin et al. | 182/207 |
| 4,216,844 | A | | 8/1980 | Klafs | 182/104 |
| 4,298,093 | A | | 11/1981 | Wing | 182/153 |
| 4,371,055 | A | | 2/1983 | Ashton et al. | 182/46 |
| 4,376,470 | A | | 3/1983 | Ashton | 182/23 |
| 4,407,045 | A | | 10/1983 | Boothe | 16/327 |
| 4,469,193 | A | * | 9/1984 | Rumsey, Jr. | 182/22 |
| 4,470,045 | A | | 9/1984 | Anderson | 340/783 |
| 4,502,566 | A | | 3/1985 | Wing | 182/214 |
| 4,566,150 | A | | 1/1986 | Boothe | 16/332 |
| 4,577,986 | A | | 3/1986 | Wang | 403/93 |
| 4,602,889 | A | | 7/1986 | Mu-Shan | 403/91 |
| 4,666,327 | A | | 5/1987 | Su | 403/24 |
| 4,666,328 | A | | 5/1987 | Ryu | 403/92 |
| 4,697,305 | A | | 10/1987 | Boothe | 16/329 |
| 4,770,559 | A | | 9/1988 | Yoo | 403/93 |
| 4,773,503 | A | | 9/1988 | Purkapile | 182/22 |
| 4,824,278 | A | | 4/1989 | Chang | 403/93 |
| D309,502 | S | | 7/1990 | Wing et al. | D25/68 |
| 4,951,780 | A | * | 8/1990 | Kim | 182/27 |
| 4,974,701 | A | | 12/1990 | Parise | 182/194 |
| 5,026,198 | A | | 6/1991 | Lin | 403/27 |
| 5,074,377 | A | | 12/1991 | Krause | 182/167 |
| 5,163,532 | A | | 11/1992 | McCarty | 182/163 |
| 5,228,535 | A | | 7/1993 | McCarty | 182/163 |
| 5,353,892 | A | | 10/1994 | Lu | 182/163 |
| 5,487,207 | A | | 1/1996 | Rey | 16/330 |
| 5,620,272 | A | | 4/1997 | Sheng | 403/96 |
| 5,775,460 | A | | 7/1998 | Stone | 182/22 |
| 5,954,157 | A | | 9/1999 | Grimes et al. | 182/163 |
| 5,992,566 | A | | 11/1999 | Yeh | 182/163 |

* cited by examiner

CONVERTIBLE LADDER

REFERENCE TO RELATED APPLICATION

The application claims the benefit of U.S. Provisional Application No. 60/355,026, filed Feb. 7, 2002, the disclosure of which is hereby incorporated by reference.

FIELD OF THE INVENTION

The present invention relates generally to a ladder. More particularly, the present invention relates to a convertible ladder.

BACKGROUND OF THE INVENTION

For some time it has been known that constructing ladders with two sections that are slidably mounted with respect to each other enables the overall length of the extension ladder to be varied depending upon the desired use of the extension ladder. This feature is particularly useful for transporting the ladder to a desired use location.

It is also known to construct ladders with two sections that are pivotally mounted together. Using this type of ladder enables the ladder to be used in locations where it is not possible to lean the ladder against a support structure such as a wall.

SUMMARY OF THE INVENTION

The present invention is a convertible ladder that includes a first ladder portion, a second ladder portion and a static hinge. The static hinge is attachable to the first ladder portion and the second ladder portion to maintain the first ladder portion in a stationary position with respect to the second ladder portion.

DETAILED DESCRIPTION OF THE PREFERRED EMBODIMENTS

Figure 1:
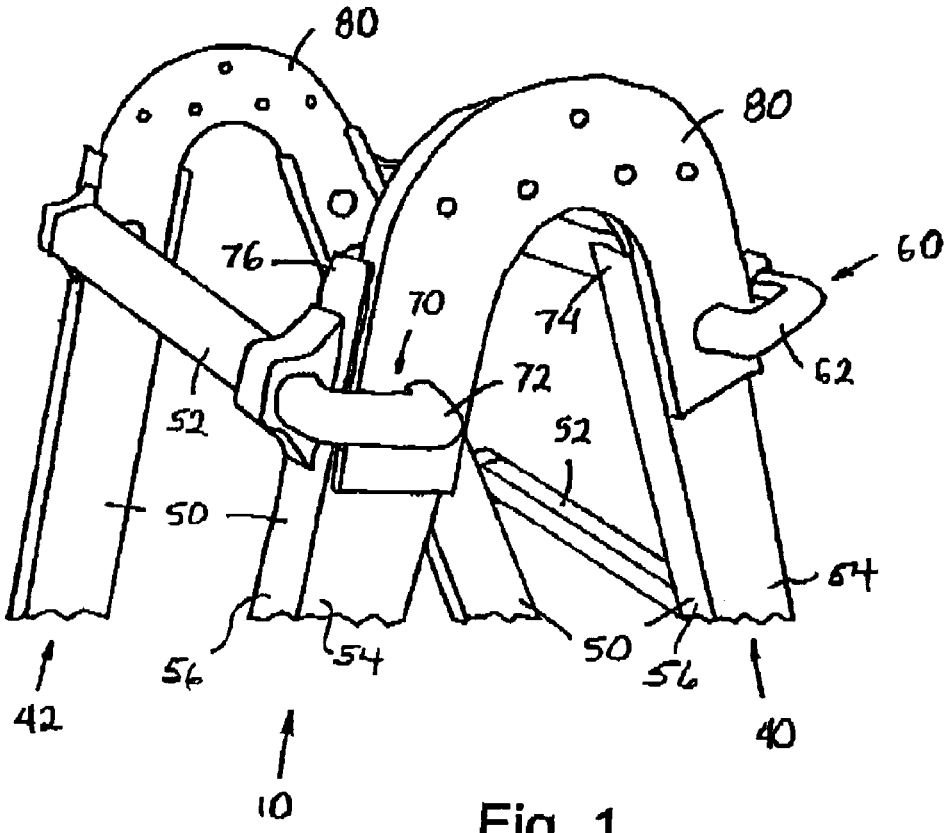
FIG. 1 is a photograph of a convertible ladder according to the present invention.

The present invention is a convertible ladder, as most clearly illustrated at 10 in FIG. 1. The convertible ladder 10 includes a first ladder portion 40, a second ladder portion 42 and a static hinge mechanism 80.

The first ladder portion 40 and the second ladder portion 42 each include a pair of side rails 50 and a plurality of rungs 52 that are mounted to extend between the side rails 50 at selected intervals. The side rails 50 preferably have a C-shaped configuration with a main section 54 and a pair of leg sections 56 that extend from the main section 54. A person of ordinary skill in the art will appreciate that the size of the side rails 50 and the rungs 52 is selected based upon the intended use of the convertible ladder.

The first ladder portion 40 and the second ladder portion 42 are preferably fabricated from a lightweight aluminum material. However, a person of ordinary skill in the art will appreciate that it is possible to fabricate the first ladder portion 40 and the second ladder portion 42 from alternate materials such as steel and fiberglass using the concepts of the present invention.

The first ladder portion 40 and the second ladder portion 42 have a pair of first locking mechanisms 60 and a pair of second locking mechanisms 70, respectively. The first locking mechanisms 60 are attached to the first and second legs 50 of the first ladder portion 40 proximate a first end 74 thereof. Similarly, the second locking mechanisms 70 are attached to the first and second legs 50 of the second ladder portion 42 proximate a first end 76 thereof.

Only one of the pair of first locking mechanisms 60 and the pair of second locking mechanisms 70 is illustrated in FIG. 1 because of the orientation of the convertible ladder 10. However, the convertible ladder 10 preferably has a symmetrical configuration where each of the first locking mechanisms 60 and the second locking mechanisms 70 are shaped substantially identical. The first locking mechanisms 60 and the second locking mechanisms 70 enable the static hinge mechanism 80 to be attached to the first ladder portion 40 and the second ladder portion 42.

The first locking mechanism 60 preferably includes a first handle 62 that is operably attached to the first ladder portion 40. The first handle 62 is movable between in an engaged position and an unengaged position. The first handle 62 is preferably biased to the engaged position. When in the engaged position, the first handle 62 engages the static hinge mechanism 80 and thereby maintains the first ladder portion 40 in a fixed position with respect to the static hinge mechanism 80. When in the disengaged position, the first handle 62 permits the first ladder portion 40 to be separated from the static hinge mechanism 80.

Similar to the first locking mechanism 60, the second locking mechanism 70 preferably includes a second handle 72 that is operably attached to the second ladder portion 42. The second handle 72 is movable between in an engaged position and an unengaged position. The second handle 72 is preferably biased to the engaged position. When in the engaged position, the second handle 72 engages the static hinge mechanism 80 and thereby maintains the second ladder portion 42 in a fixed position with respect to the static hinge mechanism 80. When in the disengaged position, the second handle 72 permits the second ladder portion 42 to be separated from the static hinge mechanism 80.

Figure 2:
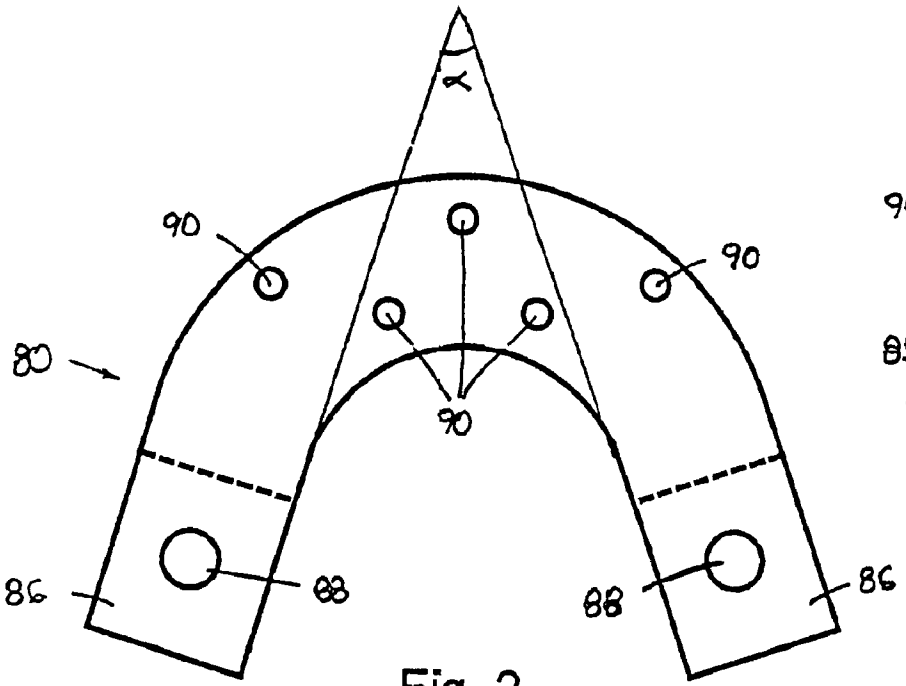
FIG. 2 is a side view of a fixed hinge mechanism for use with the convertible ladder.
Figure 4:
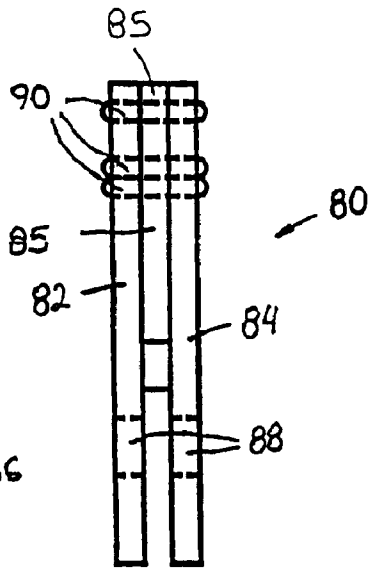
FIG. 4 is a side view of the fixed hinge mechanism.
Figure 3:
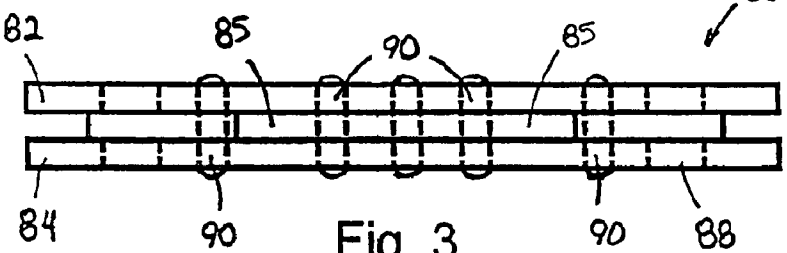
FIG. 3 is a top view of the fixed hinge mechanism.

The structure of the fixed hinge mechanism 80 is most clearly illustrated in FIGS. 2–4. The fixed hinge mechanism 80 includes a first plate 82 and a second plate 84 that are attached together in a spaced-apart configuration.

The first plate 82 and the second plate 84 each preferably have a generally U-shaped configuration. An angle $\alpha$ between hinge legs 86 is less than 90 degrees, preferably between 20 and 50 degrees and most preferably about 35 degrees. A person of ordinary skill in the art will appreciate that the angle $\alpha$ is selected based upon the desired use conditions such as the weight that is to be placed on the first and second ladder portions 40, 42.

A length of the hinge legs 86 is selected so that the hinge legs 86 extend sufficiently into the first ladder portion 40 and the second ladder portion 42 to prevent the first ladder portion 40 and the second ladder portion 42 from rotating with respect to each other, as illustrated in FIG. 1.

Proximate the end of the hinge legs 86, each of the hinge legs 86 has an aperture 88 formed therein. The aperture 88 is adapted to receive either the first handle 62 or the second handle 72 to thereby retain the fixed hinge mechanism 80 in a fixed position with respect to the first ladder portion 40 and the second ladder portion 42.

Positioned between the first plate 82 and the second plate 84 is an intermediate plate 85. The intermediate plate 85 maintains the first plate 82 and the second plate 84 in a spaced apart relationship. The intermediate plate 85 also limits the extent to which the first ladder portion 40 and the second ladder portion 42 can be inserted into the fixed hinge mechanism 80.

The first plate 82, the second plate 84 and the intermediate plate 85 are attached to each other with a plurality of reinforcing members 90. The number and size of the reinforcing members 90 is selected based upon the anticipated load that is to be placed on the convertible ladder 10. A spacer is also provided to maintain the first plate 82 and the second plate 84 at a desired position with respect to each other. A stop is further provided on the fixed hinge mechanism 80 to limit a distance that the fixed hinge mechanism 80 may be inserted into the first side 40 and the second side 42.

The static hinge mechanism 80 is preferably fabricated from a lightweight aluminum material. However, a person of ordinary skill in the art will appreciate that it is possible to fabricate the static hinge mechanism 80 from alternate materials such as steel and fiberglass using the concepts of the present invention.

When the first ladder portion 40 is detached from the second ladder portion 42, it is possible to use these items separately. It is also possible to configure the first ladder portion 40 and the second ladder portion 42 so that the first ladder portion 40 is slidably mounted with respect to the second ladder portion 42 similar to a conventional extension ladder.

In this configuration, the second ladder portion 42 preferably includes a plurality of apertures (not shown) that extend through the side rails 50. The first handle 62 extends into the apertures to maintain the first ladder portion 40 in a fixed position with respect to the second ladder portion 42.

In operation, the convertible ladder 10 is initially in the first configuration where the first ladder portion 40 is attached to the second ladder portion 42 with the static hinge mechanism 80, as illustrated in FIG. 1.

Moving the first and second locking mechanisms 60, 70 from the engaged position to the disengaged position enables the first ladder portion 40 and the second ladder portion 42 to be separated from the static hinge mechanism 80 by sliding the first ladder portion 40 and the second ladder portion 42 away from the static hinge mechanism 80.

It is contemplated that features disclosed in this application, as well as those described in the above applications incorporated by reference, can be mixed and matched to suit particular circumstances. Various other modifications and changes will be apparent to those of ordinary skill.

What is claimed is:

1. A convertible ladder comprising:

a first ladder portion comprising a first rail, a second rail and a plurality of rungs that extend between the first rail and the second rail, wherein the first rail and the second rail are each channel shaped and have a first pair of legs joined by a first main section; and wherein the first pair of legs and the first main section define a first rail recess;

a second ladder portion comprising a third rail, a fourth rail and a plurality of rungs that extend between the third rail and the fourth rail, wherein the third rail and the fourth rail are each channel shaped and have a second pair of legs joined by a second main section, and wherein the second pair of legs and the second main section define a second rail recess;

a first non-adjustable hinge mechanism having a first end and a second end, wherein the first end and the second end each have a first hinge recess formed therein, and wherein the first hinge recesses receive the first main section on the first rail and the second main section on the third rail;

a second non-adjustable hinge mechanism having a first end and a second end, wherein the first end and the second end each have a second hinge recess formed therein, and wherein the second hinge recesses receive the first main section on the second rail and the second main section on the fourth rail, wherein the first and second non-adjustable hinge mechanisms each have a first plate, a second plate and an intermediate plate mounted between the first plate and the second plate so that the intermediate plate is parallel to and adjacent to both the first plate and the second plate, said first and second plates extending beyond the intermediate plate and defining said recesses therebetween at each end thereof; and a plurality of locking mechanisms releasably attaching the first, second, third and fourth rails to the first and second non-adjustable hinge mechanisms, wherein the first non-adjustable hinge mechanism and the second non-adjustable hinge mechanism maintain the first ladder portion and the second ladder portion in a substantially stationary relationship with respect to each other, and wherein the first plate extends into the first rail recess and the second rail access, respectively, wherein each first plate, second plate and a respective main section having aligned apertures receiving one of the plurality of locking mechanisms.

2. The convertible ladder of claim 1, wherein this first and second non-adjustable hinge mechanisms are each U-shaped and have a pair of hinge legs.

3. The convertible ladder of claim 2, wherein an angle between the hinge legs is between about 20 and 50 degrees.

4. The convertible ladder of claim 1, wherein the plurality of locking mechanisms are each movable between an engaged position and a disengaged position.

5. The convertible ladder of claim 4, wherein the plurality of locking mechanisms are each biased to the engaged position.

6. A method of operating a convertible ladder comprising:

providing a first ladder portion and a second ladder portion, wherein the first ladder portion and the second ladder portion each comprise a first rail, a second rail and a plurality of rungs that extend between the first rail and the second rail, wherein the first rail end the second rail each being channel shaped having a pair of legs joined by a main section, and wherein the pair of legs and the main section define a rail recess;

providing a first non-adjustable hinge mechanism having a first end and a second end, wherein the first end and the second end each have a first hinge recess formed therein;

providing a second non-adjustable hinge mechanism having a third end and a fourth end, wherein the third end and the fourth end each have a second hinge recess formed therein, wherein the first and second non-adjustable hinge mechanisms each have a first plate, a second plate and an intermediate plate mounted between the first plate and the second plate so that the intermediate plate is parallel to and adjacent to both the first plate and the second plate, said first and second plates extending beyond the intermediate plate and defining said recesses therebetween at each end thereof; and extending the main sections on the first rails into the first hinge recess in the first and second ends of the first non-adjustable hinge mechanism;

extending the main sections on the second rails into the second hinge recess in the third and fourth ends of the second non-adjustable hinge mechanism;

extending the first plate into the rail recesses on the legs of the first ladder portion and the second ladder portion;

attaching the first rails to the first non-adjustable hinge mechanism with a first locking mechanism extending through aligned apertures respective first plates, second plates, and first main rail section; and attaching the second rails to the second non-adjustable hinge mechanism with a second locking mechanism extending through aligned apertures respective first plates, second plates, and second rails main section.

7. The method of claim 6, and further comprising:

extending a portion of the first non-adjustable hinge mechanism into the rail recess on the first rails; and extending a portion of the second non-adjustable hinge mechanism into the rail recess on the second rails.

8. The method of claim 6, wherein the first and second non-adjustable hinge mechanisms are each U-shaped and have a pair of hinge legs, and wherein an angle between the hinge legs is between about 20 and 50 degrees.

9. The method of claim 6, wherein the first and second locking mechanisms are each movable between an engaged position and a disengaged position.

10. The method of claim 9, wherein the first and second locking mechanisms are each biased to the engaged position.

11. A convertible ladder comprising:

a first ladder portion comprising:

a first rail defining a first rail recess;

a second rail defining a second rail recess;

a plurality of rungs extending between the first rail and the second rail;

a first locking mechanism operably connected to the first ladder portion; and a second locking mechanism operably connected to the first ladder portion;

a second ladder portion comprising:

a third rail;

a fourth rail;

a plurality of rungs extending between the third rail and the fourth rail;

a third locking mechanism operably connected to the second ladder portion; and a fourth locking mechanism operably connected to the second ladder portion;

a first non-adjustable hinge mechanism releasably attached to the first rail with the first locking mechanism and to the third rail with the third locking mechanism; and a second non-adjustable hinge mechanism releasably attached to the second rail with the second looking mechanism and to the fourth rail with the fourth locking mechanism;

wherein the first and second non-adjustable hinge mechanisms each have a first plate, a second plate and an intermediate plate mounted between the first plate and the second plate so that the intermediate plate is parallel to and adjacent to both the first plate and the second plate, and said first and second plates extending beyond the intermediate plates at both ends thereof and defining hinge recesses therebetween; and wherein each of the rails is received in a respective hinge recess, and each first and second plates and a respective rail having aligned apertures receiving a respective locking mechanism therethrough portions, respectively.

12. The convertible ladder of claim 11, wherein the first and second non-adjustable hinge mechanisms are each U-shaped and have a pair of hinge legs.

13. The convertible ladder of claim 12, wherein an angle between the hinge legs is between about 20 and 50 degrees.

14. The convertible ladder of claim 11, wherein the first and second locking mechanisms are each movable between an engaged position and a disengaged position.

15. The convertible ladder of claim 14, wherein the first and second locking mechanisms are each biased to the engaged position.

* * * * *

UNITED STATES PATENT AND TRADEMARK OFFICE

CERTIFICATE OF CORRECTION

PATENT NO. : 6,886,659 B2
DATED : May 3, 2005
INVENTOR(S) : Simpson

It is certified that error appears in the above-identified patent and that said Letters Patent is hereby corrected as shown below:

Column 3,
Line 58, delete ";" and insert -- , --.

Column 4,
Line 28, delete "access" and insert -- recess --.

Column 6,
Line 15, delete "looking" and insert -- locking --.

Signed and Sealed this

Twelfth Day of July, 2005

JON W. DUDAS
*Director of the United States Patent and Trademark Office*